US005997264A

United States Patent [19]

Klein et al.

[11] Patent Number: 5,997,264

[45] Date of Patent: Dec. 7, 1999

[54] SHAFT FOR A MAGNETIC-DRIVE CENTRIFUGAL PUMP USING A PLURALITY OF GROOVES

[75] Inventors: Manfred P. Klein, Highland Park; Jeffrey S. Brown, Palatine, both of Ill.

[73] Assignee: Ansimag Incorporated, Elk Grove Village, Ill.

[21] Appl. No.: 08/844,405

[22] Filed: Sep. 28, 1996

Related U.S. Application Data

[62] Division of application No. 08/378,774, Jan. 26, 1995, Pat. No. 5,641,275.

[51] Int. Cl.[6] ..... F04B 17/00; F04B 53/18

[52] U.S. Cl. ..... 417/420; 417/370; 418/176

[58] Field of Search ..... 417/420, 423.8, 417/366, 370, 368, 369; 384/29, 115; 382/291; 415/176, 115

[56] References Cited

U.S. PATENT DOCUMENTS 3,781,073 12/1973 Jorn et al. ..... 308/238

3,994,542 11/1976 Wojdyla ..... 308/22

5,641,275 6/1997 Klein et al. ..... 417/420

*Primary Examiner*—Timothy S. Thorpe

*Assistant Examiner*—Cheryl J. Tyler

*Attorney, Agent, or Firm*—Darin Bartholomew

[57] ABSTRACT

The grooved shaft preferably has one or more axial grooves with semi-elliptical or U-shaped groove cross sections. Flat areas adjoin the axial groove or grooves. The flat areas are tapered tangentially relative to a substantially cylindrical shaft area. The grooved shaft optimally has a front shaft radius and a rear shaft radius. The front shaft radius is smaller than the rear shaft radius such that the front shaft radius may be oriented near an impeller intake to decrease hydraulic flow resistance. In practice, the grooved shaft is incorporated into a magnetic-drive centrifugal pump and the grooves are statically oriented in a position of minimal radial loading.

25 Claims, 6 Drawing Sheets

SHAFT FOR A MAGNETIC-DRIVE CENTRIFUGAL PUMP USING A PLURALITY OF GROOVES

This is a division of Ser. No. 08/378,774, filed on Jan. 26, 1995.

TECHNICAL FIELD

The present invention relates generally to a shaft for a centrifugal pump, and more particularly, to a grooved shaft for a magnetic-drive centrifugal pump.

BACKGROUND ART

Magnetic-drive centrifugal pumps may be classified as synchronous or nonsynchronous. Synchronous pumps generally use magnetic coupling between a first magnetic cylinder and a second magnetic cylinder, which are separated by a containment shell. The first magnetic cylinder is coaxially oriented with respect to the second magnetic cylinder. Nonsynchronous drive centrifugal pumps use eddy current coupling between a magnetic cylinder and a torque ring, which is typically made of steel and copper. For nonsynchronous magnetic-drive pumps, the magnetic cylinder is coaxially oriented with respect to the torque rina.

Background art magnetic-drive centrifugal pumps frequently use journal or sleeve-type bearings in conjunction with a pump shaft. For optimum operation, sleeve-type bearings require the formation of a thin lubricating film between the shaft and the bearing surfaces. whether or not the requisite lubricating film is formed between the shaft and the bearing surfaces may depend upon the viscosity of the lubricant, the rotational speed of the surfaces, and the load pressure applied to the surfaces.

There are two basic lubrication operating regimes for the shaft and bearing surfaces: (1) a hydrodynamic film lubrication regime, in which wear of the surfaces is minimal or nonexistent, and (2) a mixed film lubrication regime, in which wear of the surfaces occurs. In the hydrodynamic film lubrication regime a thin lubricating film is present and prevents the shaft journal from directly contacting the bearing surface. On the other hand, in the mixed film lubrication regime a journal is partially supported by a thin lubricating film and partially supported by direct rubbing contact between the wearing surfaces.

Background art journal bearings and sleeve-type bearings may have axial, curved, helical, or spiral grooves to improve distribution of the lubricant on bearing and shaft surfaces. However, a groove in a journal bearing invariably results in increased wear of an associated shaft journal or decreased radial loading capacity of an associated shaft. A grooved bearing has less surface area for supporting a given radial load than a conventional bearing without a groove. Therefore, a grooved bearing typically operates in the mixed film lubrication regime. If, for example, a grooved journal bearing is used in conjunction with a stationary shaft, then the groove in the journal bearing rotates in alignment with the radial load force vector upon each revolution of the bearing. In general, when the groove is in alignment with the radial load force vector, then the shaft and the bearing surfaces operate in the mixed film lubrication regime. Hence, the mixed film lubrication causes the shaft or bearing surfaces to wear and may damage the shaft or bearing surfaces. Moreover, spiral or curved grooves, in the cylindrical interior surfaces of journal bearings, are difficult to machine when the bearings are constructed from hardened metals or ceramics.

Magnetic-drive centrifugal pumps typically use sleeve-type or journal bearings that are lubricated by the pumped fluid. For example, FIG. 1 discloses a prior art bearing 10 and a prior art shaft 24, which are product-lubricated. The prior art shaft 24 has a substantially cylindrical shaft surface 28 with an optional threaded segment 32 for affixing the shaft 24 to a vaned rotor. The prior art shaft 24 also has a head 26 to facilitate attachment to a rotatable magnetic cylinder or a torque ring. The prior art bearing 10 includes a sleeve 14 with a cylindrical inner surf ace 16. The cylindrical inner surface 16 comprises an appropriate product lubricated wearing surface. The prior art bearing 10 has bypass holes 20 axially extending through the bearing 10. In addition, a face of the bearing 10 preferably has radial notches 18.

FIG. 2 illustrates the prior art bearing 10 and the prior art shaft 24 incorporated into a magnetic-drive centrifugal pump wherein the prior art shaft 24 is rotatable. The prior art bearing 10 1s secured to the casing 54 by bearing holder 50. The prior art shaft 24 is affixed to the vaned rotor 36 and is secured by a shaft nut 34. The prior art shaft 24 is also attached to a torque ring 44. The vaned rotor 36 is bounded by a front wear ring 38 and rear wear ring 40. Similarly, the prior art bearing 10 is bounded by a front thrust washer 46 and a rear thrust washer 48. A containment barrier 42 is secured to the casing 54. The casing 54 has an internal channel 52 extending from the periphery of the rotor 36 to the torque ring 44.

While the majority of the fluid is conveyed from the casing inlet 56 to the casing outlet 58, a minority of the fluid is circulated via the channel 52 of the pump to provide lubrication and cooling of the prior art shaft 24 and the prior art bearing 10. A main fluid flow path 60, and a internal circulation path, which includes a bushing flow path 62 and a bypass flow path 64 are shown in FIG. 2 as dotted lines with arrows indicating the direction of flow. The main fluid flow path 60 extends from the casing inlet 56 to the casing outlet 58. The internal circulation path starts near the rotor's discharge at a starting point 68. From the starting point 68 the internal circulation fluid path contacts the wearing surfaces of the bearing 10 and the shaft 24 via the bushing flow path 62. The internal circulation path includes the bypass flow path 64 through the bypass holes 20. Finally, the internal circulation path ends near the eye of the vaned rotor 36 at a termination point 72. The internal circulation occurs because of the pressure-velocity differential between the starting point 68 and the termination point 72. Specifically, the starting point 68 is near the high pressure of the casing outlet 58 and the termination point 72 is near the suction of the vaned rotor 36.

In the prior art pump shown in FIG. 2, the bypass holes 20 may pass liquid while gases and vapor accumulate at the interface between the bearing 10 and the shaft 24. Therefore, the product-lubricated wearing surfaces of the bearing 10 and shaft 24 are exposed to intervals of diminished lubrication because of the presence of the vapor component of the pumped fluid. The selective and problematic routing of vapor and gases to the wearing surfaces is caused by the centrifugal action fluid near the bearing 10.

In general, another problem in background art centrifugal pumps is that particulate matter, or solid particles, in the pumped fluid become trapped in the space between the bearing surface and the pump shaft. Trapped particles may scratch or score either the bearing or the shaft surfaces causing premature bearing or bearing failure. Some particles may even may adhere to the shaft or bearing surfaces; especially after the shaft surfaces have been scratched or scored. Moreover, trapped particles lodged in the internal circulation path may further impede the cooling of the shaft. Cooling may be impeded because of increased hydraulic resistance of the congested bushing flow path. In addition, thermal problems may arise from particles adhering to bearing or shaft surfaces and preventing pumped fluid (i.e. lubricant) from contacting these surfaces.

Thus, a need exists for an improved shaft for a magnetic-drive centrifugal pump. In particular, a need exists for a shaft which reduces or ameliorates thermal problems and shaft scoring associated with trapped particles at the pump shaft-bearing interface. Moreover, a need exists for a shaft and bearing combination having increased longevity compared to prior art shaft and bearing combinations.

SUMMARY OF THE PRESENT INVENTION

The grooved shaft for a magnetic-drive centrifugal pump preferably has one or more axial grooves with semi-elliptical or U-shaped groove cross sections. Adjoining each axial groove is a flat area which is tapered tangentially to a substantially cylindrical area. The grooved shaft optimally has a front shaft radius and a rear shaft radius, wherein the front shaft radius is smaller than the rear shaft radius to decrease hydraulic flow resistance near or at an impeller intake. Meanwhile, the rear shaft radius provides increased axial and radial load capacity. The grooved shaft is preferably constructed from a ceramic compound, such as silicon carbide.

In practice, the grooved shaft is incorporated into a magnetic-drive centrifugal pump such that the shaft is stationary and a bearing rotates about the shaft. The grooved shaft forms a channel for the internal circulation of pumped fluid about the product-lubricated wearing surfaces so the grooved shaft and an associated bearing are amply lubricated and so that particulate matter in the pumped fluid has a reliable, immobile channel for bypassing the wearing surfaces. The grooved shaft allows the bearing and the shaft surfaces to establish a lubricating film more quickly upon initial start-up of the pump than was previously established by background art pumps having grooved journal bearings. The axial groove or grooves provide particulate matter, which exceeds the size of the clearance between the grooved shaft and bearing, a viable escape route from the clearance between the grooved shaft and the bearing to the outlet of the pump. In addition, the grooved shaft has a shaft cross section which is contoured to remove particles from the shaft-bearing interface.

The grooved shaft is preferably positioned to minimize loading on one or more axial grooves. Strategically orienting the grooved shaft within the centrifugal pump improves the longevity of the bearing and the grooved shaft by decreasing the possibility that the bearing and shaft are operating in the mixed film lubrication regime.

DESCRIPTION OF THE DRAWINGS

FIG. 4 depicts the shaft having a first groove and a second groove.

DETAILED DESCRIPTION

The present invention includes various embodiments of notched shafts or grooved shafts to improve cooling, lubrication, or particulate bypass of the shaft-bearing interface. The combination of a grooved shaft and a corresponding bearing may be sold as an upgrade kit for field modification of existing centrifugal pumps. In addition, the grooved shaft may be incorporated into a new magnetic-drive centrifugal pump or a centrifugal pump having a product lubricated bearing. Features such as nonmetallic containment shells and ribbed interior pump structures may further complement the cooling and lubrication functions of the grooved shaft.

Grooved Shaft

Figure 1:
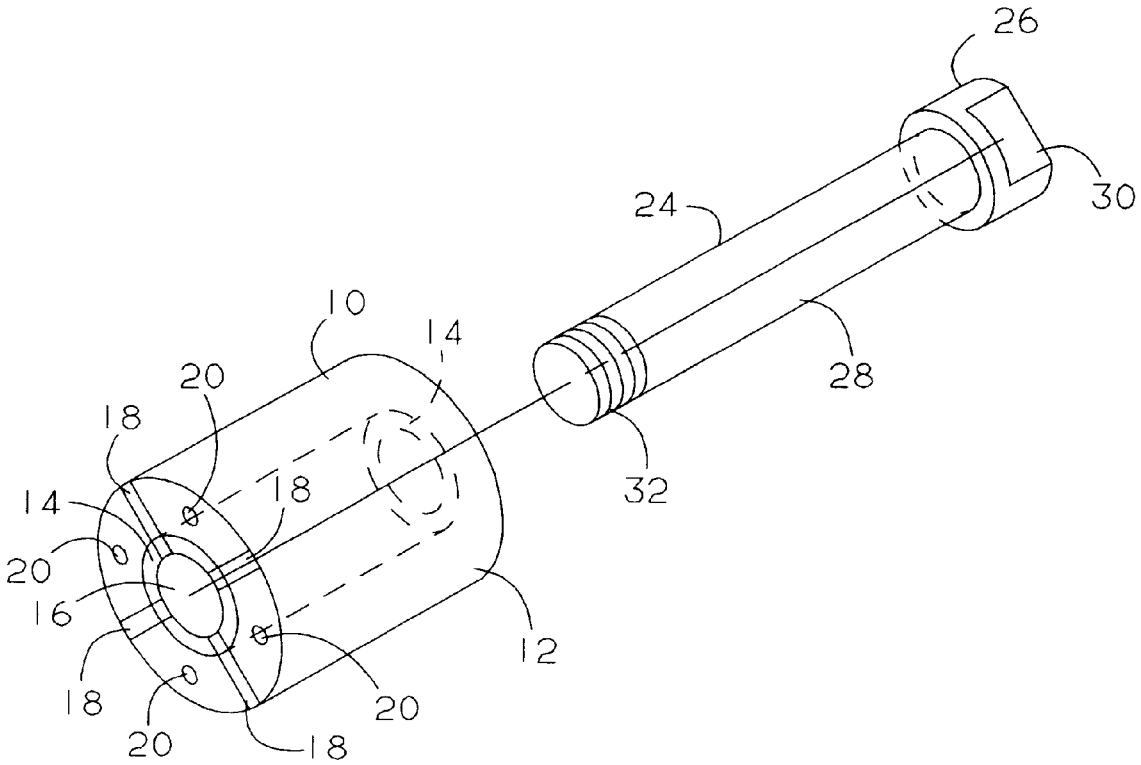
FIG. 1 (PRIOR ART)
FIG. 1 shows an exploded perspective view of a prior art shaft and a prior art bearing having axial bypass holes.
Figure 2:
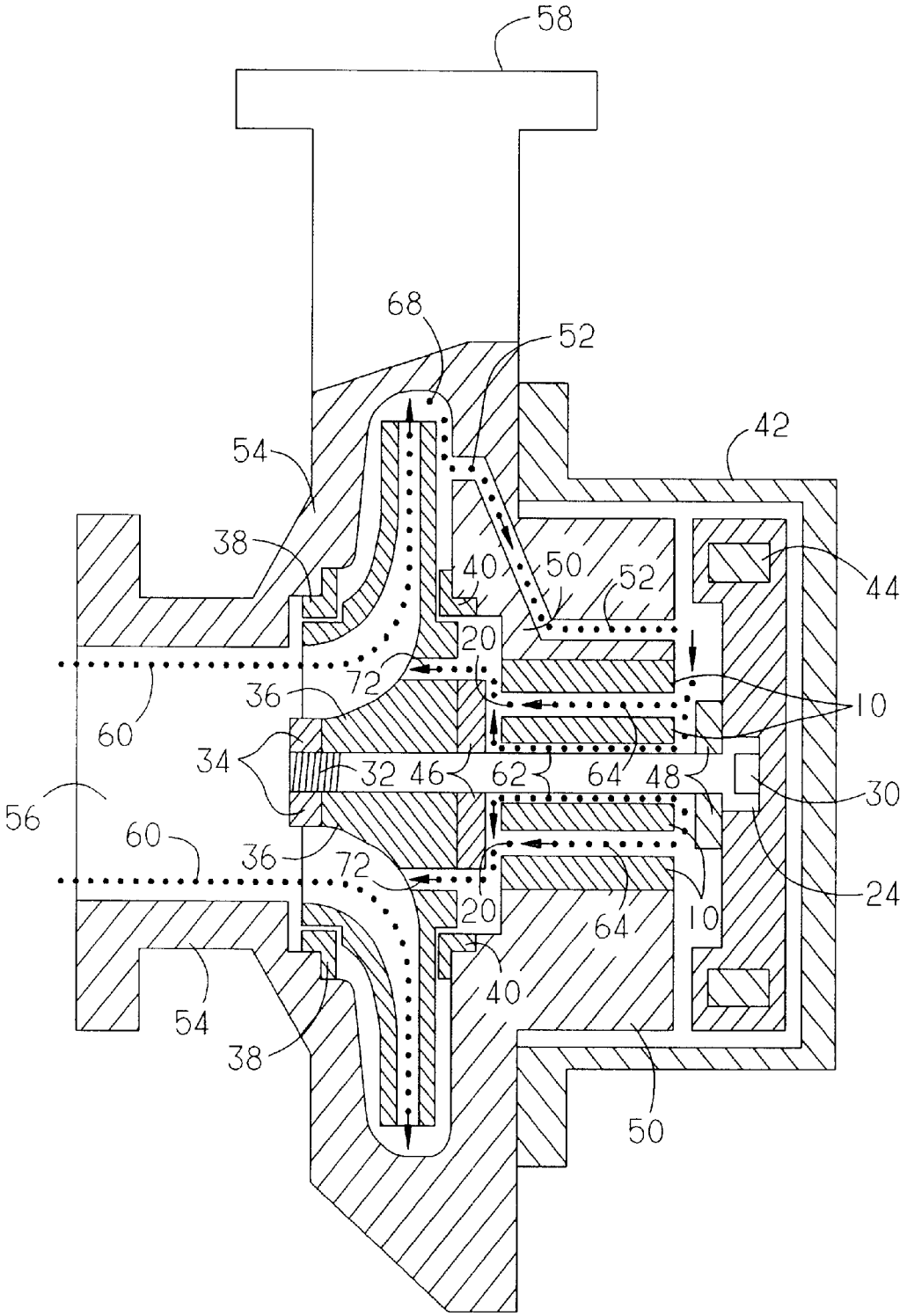
FIG.2 (PRIOR ART)
FIG. 2 shows a cross-sectional view of a centrifugal pump incorporating the prior art shaft and the prior art bearing of FIG. 1.
Figure 3:
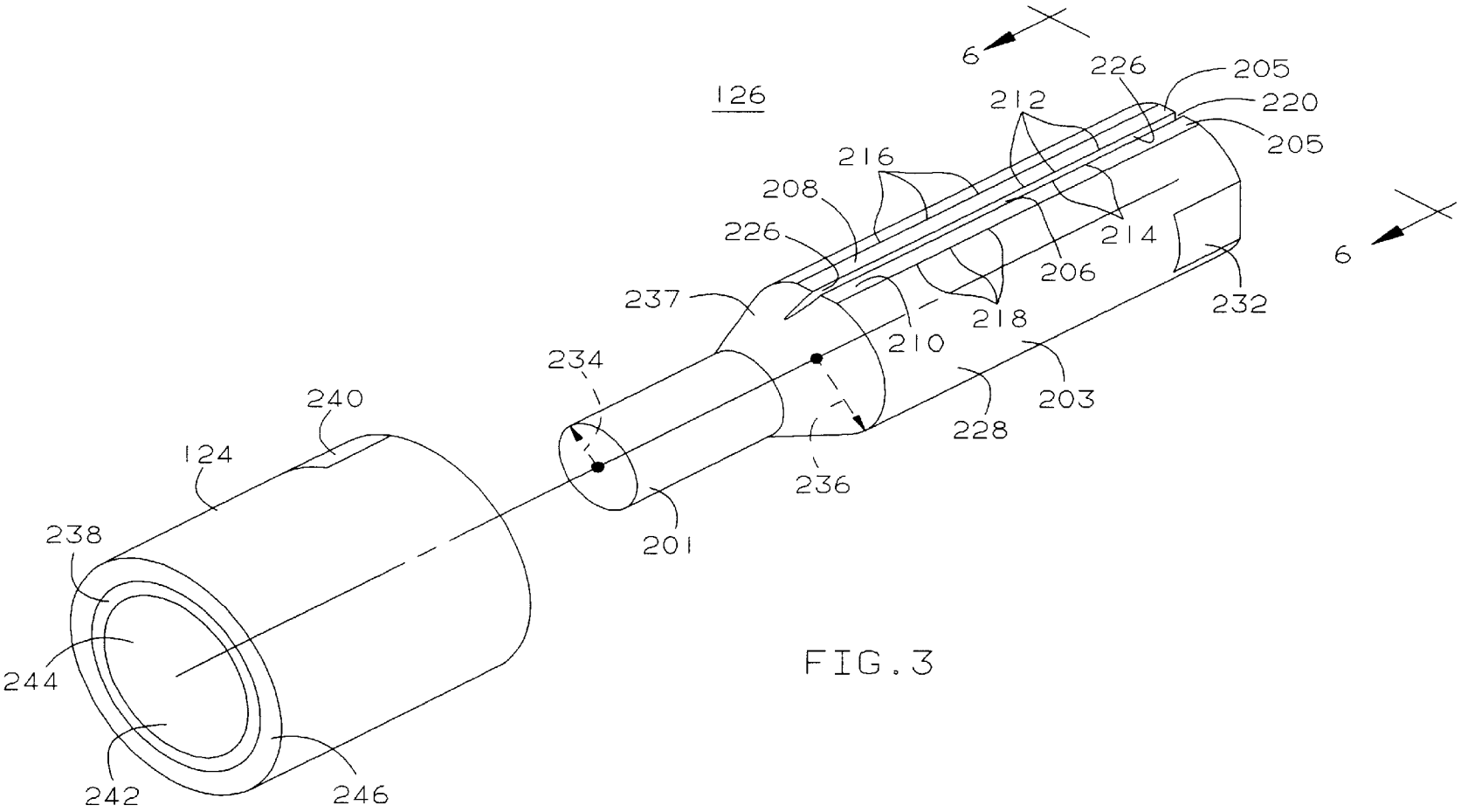
FIG. 3 shows an exploded perspective view of one embodiment of the grooved shaft and its associated bearing.
Figure 6:
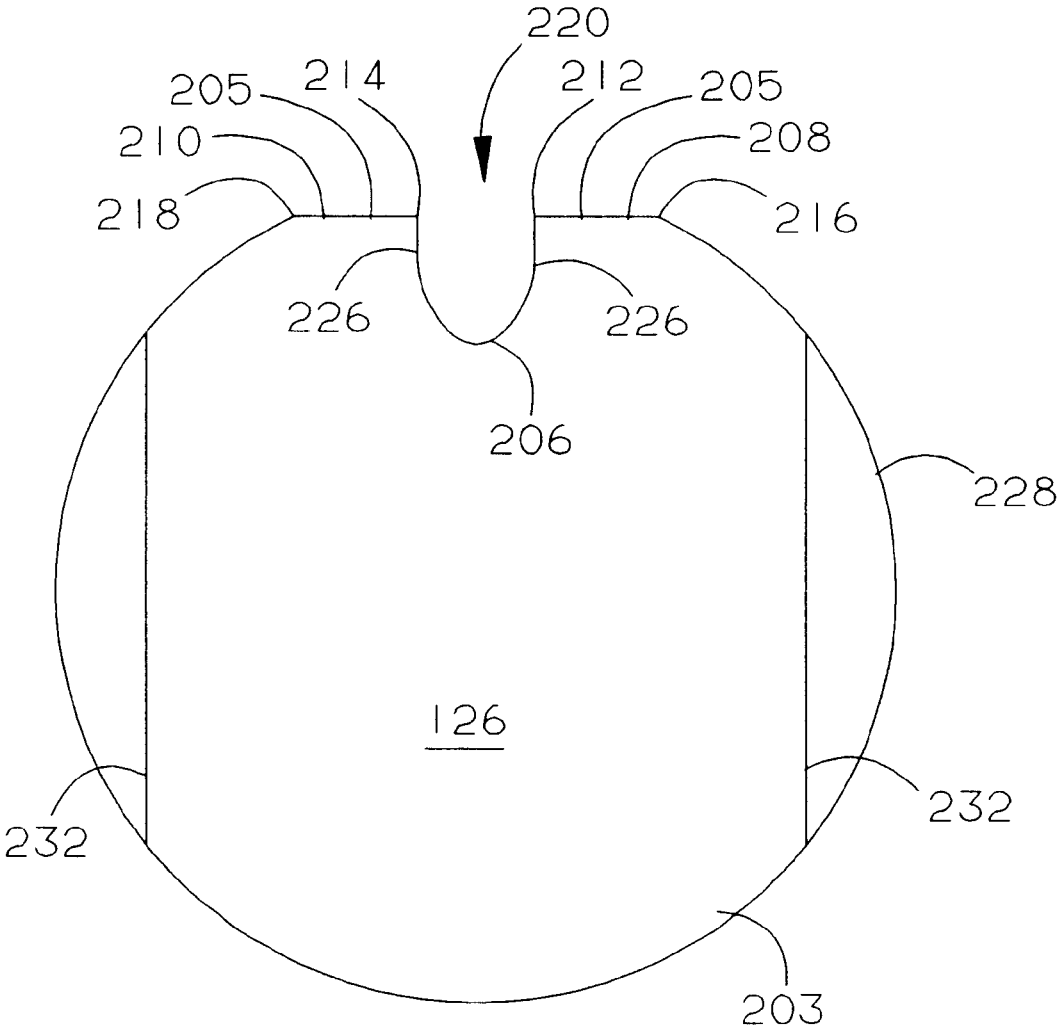
FIG. 6 shows an elevational view of the shaft as viewed along reference lines 6—6 of FIG. 3.

A preferred embodiment of the grooved shaft is illustrated in FIGS. 3 and 6. In the preferred embodiment, the grooved shaft 126 has an axial groove 206. The axial groove 206 preferably has a groove cross section 220 with a semi-elliptical shape, a semi-circular shape, or a U-shape. Alternatively, the axial groove 206 may have a groove cross section with a rectangular shape, a trapezoidal shape, a V-shape, or the like. The groove cross section 220 has a groove depth and a groove width which may be varied according to the size of the particulate matter to be transmitted via the axial groove 206.

The grooved shaft 126 preferably has surface area contours including a flat area 205 and a cylindrical area 228, which result in the grooved shaft 126 having a shaft cross section that is an irregular circle (i.e. eccentric). The flat area 205 surrounds the axial groove 206. The cylindrical area 228 bounds the flat area 205.

The flat area 205 is subdivided into a first flat region 208 and a second flat region 210. One side 226 of the groove 206 meets the first flat region 208 at a first boundary 212. Another side 226 of the groove 206 meets the second flat region 210 at a second boundary 214. The groove 206 optimally has sides 226 which are substantially perpendicular to the flat area 205. Removal means for removing particulate matter from the shaft-bearing interface comprise, for example, (a) sides 226 that are substantially radially extending with respect to the axis of the grooved shaft 126, or (b) sides 226 that are substantially orthogonal relative to the flat area 205.

The cylindrical area 228 adjoins the flat area 205 at a third boundary 216 and a fourth boundary 218. In particular, the cylindrical area 228 adjoins the first flat region 208 at the third boundary 216. The cylindrical area 228 adjoins the second flat region 210 at the fourth boundary 218. The third boundary 216 is gradually tapered with respect to the cylindrical area 228. Likewise, the fourth boundary 218 is gradually tapered with respect to the cylindrical area 228.

The third boundary 216 and the fourth boundary 218 have predetermined tolerances for surface roughness and all rough edges are broken, for example, at one hundredth (0.01) of an inch (tolerance 0.005 inch). The third boundary 216 and fourth boundary 218 are precisely finished, filed, ground, machined, or polished tangentially to the cylindrical area 228. The elimination of sharp edges at or near the third boundary 216 and the fourth boundary 218 is essential to prevent undue wear of the wearing surfaces of the shaft 126 and the bearing 124. Tapering of the surface area contours, and the shaft cross section, prevents wear if the radial loading force on the shaft shifts direction from one radial load force vector to another radial load force vector.

In a preferred embodiment, the grooved shaft 126 has a front portion 201 with a front shaft radius 234 and a rear portion 203 with a rear shaft radius 236. The front shaft radius 234 is generally equal to or less than the rear shaft radius 236 so that the primary flow past the front portion 201 may be optimized. For example, reducing the front shaft radius 234 decreases flow resistance near the impeller eye or impeller intake. The front portion 201 and the rear portion 203 may be separated by a shoulder 237. The axial groove 206 optimally extends over the entire rear portion 203. In other embodiments, the axial groove may extend the entire length of the shaft or any length necessary (i.e. journal length) to create a channel for the internal circulation of pumped fluid within the centrifugal pump.

The rear portion 203 includes retaining surface means for retaining the shaft, such as a flat mating surface 232. Retaining surface means for retaining the shaft may include a corrugated surface, a flat mating surface, a mating indentation, a hexagonal surface, a rectangular surface, or the like. In alternate embodiments, retaining surface means for retaining the orientation of the shaft may comprise the combination of a coaxial tap in the shaft, a fastener, and an optional lock washer.

The grooved shaft 126 is preferably constructed from a ceramic, such as silicon carbide. The grooved shaft 126 may also be constructed from other ceramics including silicon carbide, silicon carbide type hot isostatic process (HIP), silicon carbide type sintered alpha (SA), alumina, aluminum, bauxite, zirconia, zirconium, zironcia, ceramics, or the like. Alternatively, the grooved shaft may be constructed from tungsten carbide, tungsten carbide and nickel, tungsten carbide and cobalt, stainless steel, forged aluminum, metal, or the like.

If silicon carbide is used, first, a binder or adhesive is added to the silicon carbide powder to improve adhesion between particles of the silicon carbide powder. Second, the grooved shaft is then molded by compacting or compressing silicon carbide powder. Third, the silicon carbide powder is heated and machined into a rough approximation of the final shape. In addition, the third step may, but need not, include roughly forming the groove. Fourth, the shaft is sintered at high temperature. Fifth, the groove is preferably machined in the grooved shaft. Once the shaft is sintered; final machining, polishing, and finishing can only be accomplished by using extremely hard tools, such as diamond files. Next, the flat area is preferably formed by grinding or machining the shaft. For instance, the third and fourth boundary are tapered by filing with a diamond file after sintering. Various ceramic shafts are commercially available from ESK Engineered Ceramics, Wacker Chemicals (U.S.A.), Inc., 535 Connecticut Ave., Norwalk, Conn. 06954.

The bearing 124 comprises a sleeve-type bearing with a cylindrical hollow 242. The grooved shaft 126 coaxially mates with the cylindrical hollow 242 of the bearing 124. The bearing 124 has a sleeve 238 coaxially oriented within a bearing body 246, which may be constructed from a plastic resin such as polytetrafluoro-ethylene, ethylene-tetra-fluoro ethlene, carbon fiber filled polytetrafluoro-ethylene, carbon fiber filled ethylene-tetra-fluoro ethlene, or the like. The sleeve 238 is preferably constructed from silicon carbide, stainless steel, carbon, a metal, a ceramic, or the like. The sleeve 238 provides an appropriate product-lubricated wearing surface 244 for the grooved shaft 126. In practice, the bearing 124 may have a plurality of longitudinally spaced sleeves along the axis of the cylindrical hollow 242. A typical and acceptable clearance between the inner diameter of the sleeve 238 and the outer diameter of the grooved shaft 126 is three thousandths (0.003) of an inch.

Alternate Embodiments of a Grooved Shaft

Figure 4:
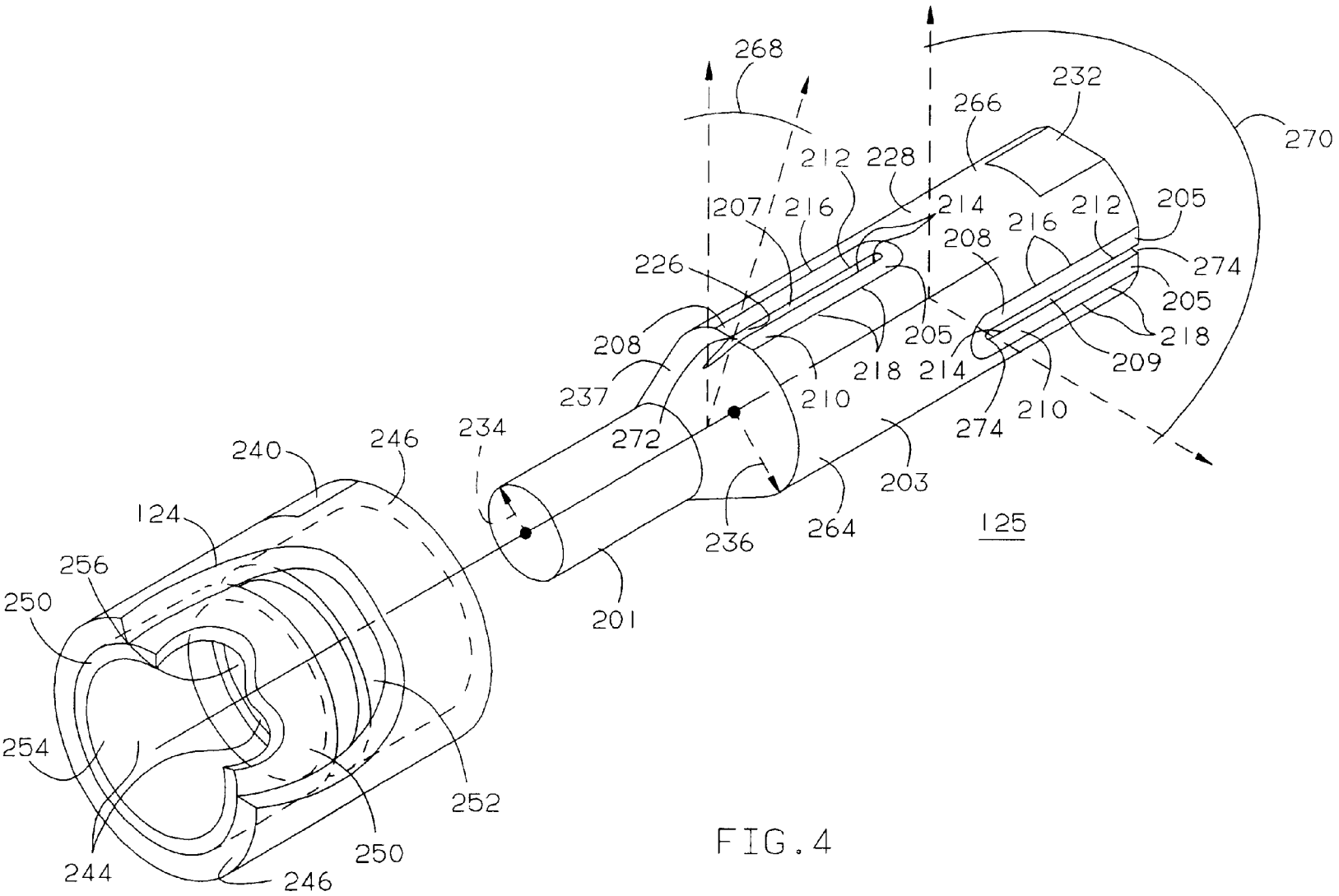
FIG. 4 illustrates an exploded perspective view of an alternate embodiment the grooved shaft and the bearing with the bearing body partially cutaway to reveal the first bushing and the second bushing.
Figure 5:
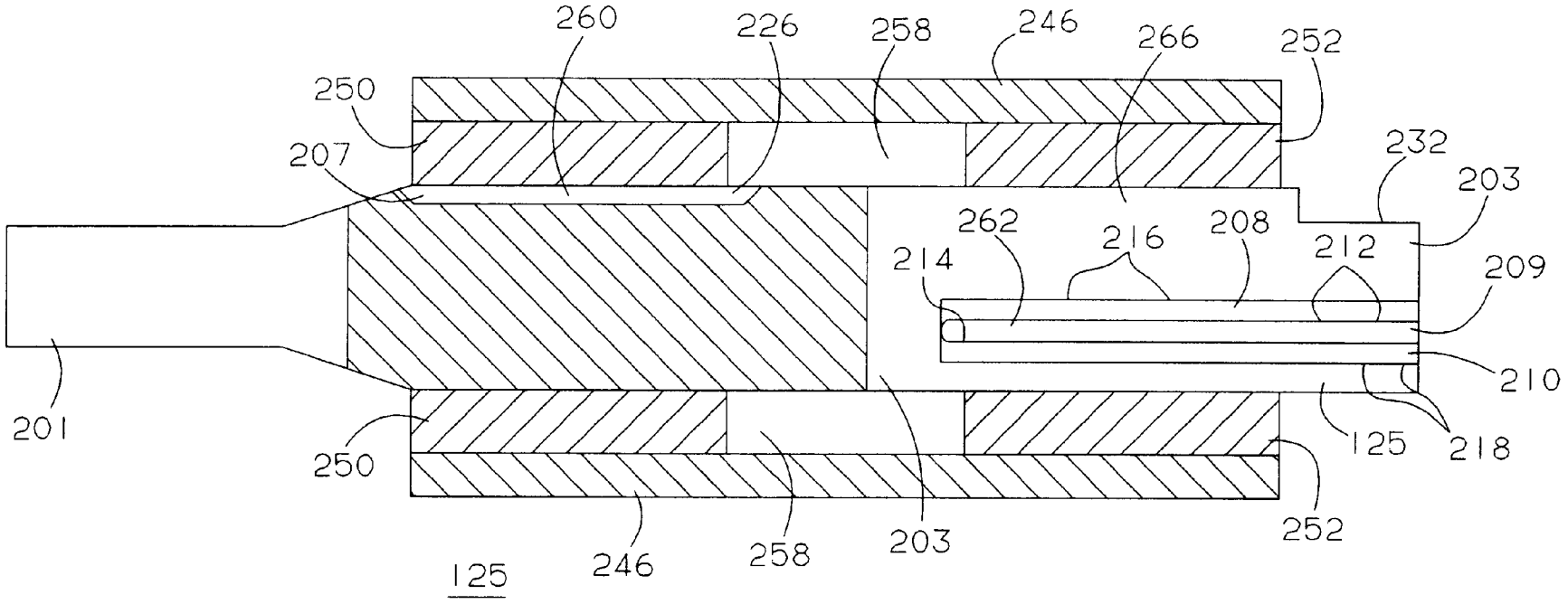
FIG. 5 illustrates a cross-sectional view of the alternate embodiment of the grooved shaft and the bearing shown in FIG. 4

An alternate shaft 125 in conjunction with a bearing 124 is illustrated in FIG. 4 and FIG. 5. The alternate shaft 125 has a first groove 207 and a second groove 209. The first groove 207 and the second groove 209 both have similar features to the axial groove 206 of FIG. 3. Like features are labeled accordingly throughout FIG. 3, FIG. 4, and FIG. 5.

The bearing 124 has a bearing body 246 that retains a first bushing 250 and a second bushing 252. The first bushing 250 and the second bushing 252 are oriented coaxially within the bearing body 246. The first bushing 250 is axially separated from second bushing 252 along an axis of the bearing body 246. A bearing cavity 258 intervenes between the first bushing 250 and the second bushing 252. The first bushing 250 has a first cylindrical hollow 254. The second bushing 252 has a second cylindrical hollow 256.

The radial loading forces that the first bushing 250 and the second bushing 252 apply to the shaft 125 may differ. The first groove 207 and the second groove 209 may be independently oriented to compensate for different radial loading force vectors. The shaft cross section of shaft 125 generally has a substantially circular outline capable of division into sectors, such as an alpha sector and a beta sector. The alpha sector and the beta sector include the alpha angle 268 and the beta angle 270, respectively.

The alpha sector is selected to provide minimal radial loading vector forces on the first groove 207. Similarly, the beta sector is selected to provide minimal radial loading vector forces on the second groove 209. The first groove 207 has a first groove cross section 272 oriented within an alpha sector at an alpha angle 268. An imaginary pair of arrows and an imaginary arc defines the alpha angle 268 in FIG. 4. The second groove 209 has a second groove cross section 274 oriented within a beta sector at a beta angle 270. An imaginary pair of arrows and an imaginary arc defines the beta angle 270.

The shaft 125 has a first journal area 264 and a second journal area 266. The first journal area 264 is associated with a first bushing 250. The first journal area 264 is defined by the surface area of the first cylindrical hollow 254. The second journal area 266 is associated with the second bushing 252. The second journal area 266 is defined by the surface area of the second cylindrical hollow 256.

The respective first groove 207 is associated with the corresponding first bushing 250. The respective second groove 209 is associated with the corresponding second bushing 252. The first groove 207 has a first groove length 260, which spans an axial dimension of the first journal area 264. The first groove length 260 preferably extends slightly beyond the first journal area 264 to provide a reliable hydraulic channel, as best illustrated by FIG. 5. The second groove 209 has a second groove length 262, which spans an axial dimension of the second journal area 266. The second groove length 262 preferably extends slightly beyond the second journal area 266 of the shaft 125 to provide a reliable hydraulic channel.

The alpha sector is, for example, determined by the radial loading forces applied to the first journal area 264 during actual centrifugal pump operating conditions or under test conditions. The beta sector is, for example, determined by the radial loading forces applied to the second journal area 266 during actual centrifugal pump operating conditions or under test conditions. Alternatively, calculations of loading may be completed to determine the desired alpha sector orientation and desired the beta sector orientation. If consistent manufacturing processes of a particular centrifugal pump are used, the calculated values or tested values for the alpha sector and the beta sector may be universally applied to produce a uniform shaft for the particular centrifugal pump.

Referring to FIG. 5, if the alternate shaft 125 were installed in a pump, then the pumped fluid would first travel through the second groove 209 to the bearing cavity from the pressure side of the impeller, then the pumped fluid would travel through the first groove 207 to the suction side of the impeller.

The shaft having one or more axial grooves is incorporated into a centrifugal pump as illustrated in U.S. patent application Ser. No. 08/378,774, invented by Manfred P. Klein and Jeffrey S. Brown, the inventors of the present invention. U.S. patent application Ser. No. 08/378,774, filed on Jan. 26, 1995, is incorporated herein by reference.

Other embodiments, which are not illustrated, are also possible. For example, the groove may follow a curved or helical path circuitously about the shaft. However, a helical shaft is susceptible to a stress fracture occurring at a point where a notch (i.e. groove) is partially or completely radially oriented with respect to the shaft. In contrast, an axial shaft is tolerant to stress from bending forces that are axially or longitudinally applied to the shaft. Therefore, an axial groove is a preferred form of the present invention because an axial groove produces minimal weakening of the shaft.

The foregoing description is provided in sufficient detail to enable one of ordinary skill in the art to make and use the grooved shaft. The foregoing detailed description is merely illustrative of several physical embodiments of the grooved shaft for the centrifugal pump. Physical variations of the grooved shaft and the centrifugal pump incorporating the grooved shaft, not fully described in the specification, are encompassed within the purview of the claims. For example, the axial groove may be curved, rather than linear. Accordingly, the narrow description of the elements in the specification should be used for general guidance rather than to unduly restrict the broader descriptions of the elements in the following claims.

We claim:

1. A bearing assembly, including a shaft and a bearing, for use in a magnetic-drive centrifugal pump, the improvement comprising:

a first groove and a second groove disposed in said shaft, the first groove being associated with a first journal area, and the second groove being associated with a second journal area, the first groove having a first groove length spanning at least an axial dimension of said first journal area and the second groove having a second groove length spanning at least an axial dimension of said second journal area.

2. The bearing assembly according to claim 1 wherein the shaft has a shaft cross section, the shaft cross section having an alpha sector and a beta sector, the first groove having a first groove cross section oriented at an alpha angle within the alpha sector, the second groove having a second groove cross section oriented at a beta angle within the beta sector, the alpha sector selected to minimize radial loading forces applied to the first groove from the first journal area, and the beta sector selected to minimize radial loading forces applied to the second groove from the second journal area.

3. The bearing assembly according to claim 2 wherein the bearing comprises a first bushing, a second bushing, and a bearing body; the first bushing and the second bushing longitudinally oriented along an axis of the bearing body, the first bushing and the second bushing coaxially retained within the bearing body; the first bushing having a first cylindrical hollow and the second bushing having a second cylindrical hollow, the shaft coaxially mating with the first cylindrical hollow and the second cylindrical hollow, the first groove providing a bypass channel for the first bushing and the second groove providing a bypass channel for the second bushing.

4. The bearing assembly according to claim 3 further comprising a bearing cavity located between the first bushing and the second bushing, and wherein the bearing cavity is hydraulically coupled to the first groove and to the second groove.

5. The bearing assembly according to claim 1 further comprising removal means for removing particulate matter from a shaft-bearing interface of the bearing assembly, the removal means being associated with a first groove cross section of the first groove and the removal means being associated with a second groove cross section of the second groove.

6. The bearing assembly according to claim 5 wherein the removal means comprises the first groove cross section and the second groove cross section having radially extending sides.

7. The bearing assembly according to claim 5 wherein flat areas adjoin the first groove and the second groove, and wherein the removal means for removing particulate matter comprises the first groove cross section and the second groove cross section having sides that are approximately perpendicular to the flat areas.

8. A shaft for use in a magnetic-drive centrifugal pump, the improvement comprising:

a plurality of axial grooves disposed in the shaft, the axial grooves having groove cross sections, the groove cross sections including sides;

substantially flat areas located on said shaft, the substantially flat areas adjoining said axial grooves; and a cylindrical area bounding the flat areas.

9. The shaft according to claim 8 wherein said sides orthogonally meet with the substantially flat areas.

10. The shaft according to claim 8 wherein the shaft includes journal areas; wherein the axial grooves follow substantially linear paths paralleling an axis of the shaft, a length of each one of said axial grooves spanning an axial dimension of the corresponding journal areas of said shaft.

11. The shaft according to claim 8 wherein the axial grooves are radially and axially displaced with respect to one another.

12. The shaft according to claim 8 wherein the groove cross sections have shapes selected from the group consisting of U-shapes, V-shapes, semi-ellipses, rectangles, and semi-circles.

13. The shaft according to claim 8 wherein the shaft has a front portion having a front shaft radius and a rear portion having a rear shaft radius, and wherein the front shaft radius is smaller than the rear shaft radius; and wherein the axial grooves are located in the rear portion.

14. The shaft according to claim 8 wherein the substantially flat areas meet the cylindrical area at boundaries, the boundaries being gradually tapered between the cylindrical area and the substantially flat areas.

15. The shaft according to claim 8 wherein each of the grooves is associated with a first boundary and a second boundary such that the shaft has a plurality of first boundaries and a plurality of second boundaries, the respective sides being approximately perpendicular to the corresponding flat areas, at the first boundaries and the second boundaries.

16. The shaft according to claim 15 wherein each of the grooves is associated with a third boundary and a fourth boundary such that the shaft has a plurality of third boundaries and a plurality of fourth boundaries; the substantially flat areas meeting the cylindrical area at the third boundaries and the fourth boundaries; the third boundaries being gradually tapered between the cylindrical area and each first region of the flat areas; the fourth boundaries being gradually tapered between the cylindrical area and each second region of the flat areas.

17. A shaft for use in a magnetic-drive centrifugal pump, the improvement comprising:

a first groove and a second groove disposed in the shaft; the first groove having a first groove cross section including sides, the second groove having a second groove cross section including sides;

substantially flat areas adjoining said grooves; and a cylindrical area bounding the flat areas.

18. The shaft according to claim 17 wherein the first groove cross section is located at an alpha angle with respect to a twelve o'clock orientation of the shaft, and wherein the second groove cross section is located a beta angle with respect to the twelve o'clock orientation of a cross section of the shaft.

19. The shaft according to claim 17 wherein said flat areas include a first flat area being associated with the first groove and a second flat area being associated with the second groove, the first flat area surrounding the first groove and the second flat area surrounding the second groove.

20. The shaft according to claim 19 wherein the shaft has two first flat regions and two second flat regions, one first flat region and one second flat region extending between said first groove and the cylindrical area, another first flat region and another second flat region extending between the second groove and the cylindrical area.

21. The shaft according to claim 19 wherein the first flat area has a first flat region and a second flat region, the first flat region extending between said first groove and the cylindrical area, the second flat region extending between the first groove and the cylindrical area.

22. The shaft according to claim 21 wherein the first flat region is bounded by a first boundary and a third boundary, the first boundary adjoining said first groove, the third boundary located next to the cylindrical area, the second flat region bounded by a second boundary and a fourth boundary, the second boundary adjoining said first groove, the fourth boundary located next to the cylindrical area.

23. The shaft according to claim 22 wherein the third boundary is tapered for a gradual transition not to exceed a predetermined maximum surface roughness between the cylindrical area and the first flat region of the first groove.

24. The shaft according to claim 22 wherein the fourth boundary is tapered for a gradual transition not to exceed a predetermined maximum surface roughness between the cylindrical area and the second flat region of the first groove.

25. The shaft according to claim 17 wherein the shaft has two first boundaries and two second boundaries, one first boundary and one second boundary being associated with the first groove; another first boundary and another second boundary being associated with the second groove; the first boundaries and the second boundaries being located at approximately orthogonal intersections of the sides and the flat areas.

* * * * *